United States Patent [19]

McGillivray et al.

[11] Patent Number: 4,599,014

[45] Date of Patent: Jul. 8, 1986

[54] BUOYANT GUYED TOWER

[75] Inventors: Terrence L. McGillivray, Santa Rosa; Thomas B. Coull, Hayward, both of Calif.

[73] Assignee: Bechtel International Corporation, San Francisco, Calif.

[21] Appl. No.: 723,784

[22] Filed: Apr. 16, 1985

[51] Int. Cl.[4] ..... E02B 17/00

[52] U.S. Cl. ..... 405/225; 405/227

[58] Field of Search ..... 405/195, 205, 207, 224, 405/225, 227, 228; 166/335, 350, 366, 367; 175/5, 9

[56] References Cited

U.S. PATENT DOCUMENTS

| | | | |
|---|---|---|---|
| 3,685,300 | 8/1972 | Mott et al. | 405/227 |
| 4,117,690 | 10/1978 | Besse | 405/227 |
| 4,363,568 | 12/1982 | Schuh | 405/227 |
| 4,417,831 | 11/1983 | Abbott et al. | 405/227 |

*Primary Examiner*—David H. Corbin

*Attorney, Agent, or Firm*—Townsend and Townsend

[57] ABSTRACT

A tower adapted to be mounted in an upright position in water depths in the range of 1200 to 2500 feet. The tower has a plurality of guy lines which extend outwardly and downwardly from the upper end of the tower to anchors in the sea bottom. The tower has a number of spaced, generally parallel legs coupled together by braces, each leg being tubular to contain a plurality of sleeves and guides rigidly secured to the inner surface of the leg. Each sleeve has a tubular pile therewithin, the upper end of each pile being rigidly connected to the upper end of the sleeve, the piles extending downwardly through respective sleeves and guides and into the sea bottom to provide a foundation for the tower. Each pile serves as a compression spring to present tension-compression couples to withstand lateral forces during rocking motion of the upper end of the tower relative to the lower end thereof. Each pile may further be adapted to house a well for transfer of hydrocarbon products from the sea bottom to the platform on the upper end of the tower. The legs have bulkheads to define air chambers to provide buoyancy to counteract vertical loads, such as the weight of the platform on the upper end of the tower.

13 Claims, 9 Drawing Figures

BUOYANT GUYED TOWER

This invention relates to improvements in deep water offshore towers for drilling of wells in the sea bottom and, more particularly, to an improved tower for withstanding forces due to wind, wave action and water currents.

BACKGROUND OF THE INVENTION

Offshore towers for supporting drilling and production platforms are now being erected in water depths over 1000 feet. Costs of constructing and erecting such towers is quite high, sometimes reaching $300 million or more for depths of over 1000 feet. For such high costs, it is mandatory that a tower installed in such water depths be sufficiently rugged in construction to withstand the various forces exerted on the tower once it is erected. Such forces include wind forces, wave forces, forces due to water currents and compression forces due to the weight of the facilities on the top of the tower.

Conventional bottom founded platforms have been constructed in a manner to counteract these forces in a satisfactory manner; however, their cost increases exponentially in water depths over 1000 feet. Because of this, a need exists for an improved offshore tower which can withstand such forces as those mentioned above so that drilling and production operations can continue in an uninterrupted manner in deep water, such as in water depths in the range of 1500 to 2500 feet. The need for improvements in towers of this type further includes the desirability of reducing the cost of deep-water drilling and production platforms while not compromising platform safety or without departing from conventional offshore operating procedures. The present invention satisfies the aforesaid needs.

SUMMARY OF THE INVENTION

The present invention is directed to an improved tower for serving as an offshore platform for drilling and production of deep-water oil and gas reserves. The tower is comprised of a number of large diameter, generally vertical legs which contain the piling and wells of the platform. The legs are braced together to form a long, slender space frame which rests vertically on the sea bottom and extends upwardly from the mud line to an elevation well above the mean water level of the sea. The piling extends out of the lower ends of the legs and into the sea bottom to a predetermined depth.

The foundation of the platform is comprised of the piling which extends through the legs, supplemented in some cases by a number of shear piles clustered around the base of the tower to increase the lateral resistance at the foundation of the tower. The arrangement of the piling in the legs reduces current and wave forces on the wells and the use of these wells as a main platform piling also serves to resist a portion of the vertical loads on the tower.

The legs are divided into compartments which are closed to serve as buoyancy chambers. Such chambers provide a large amount of buoyancy which relieves foundation loads and provides a restoring force to counteract the weight of the platform. Water-tight bulkheads at each framing level of the tower plus continuous sleeves that contain the piling and the wells which extend through the buoyant zone provide safety against accidental flooding.

An array of guy lines are secured to the tower near the water surface. The guy lines extend outwardly and downwardly from the tower in all directions, the lower ends of the guy lines being secured to anchors in the sea bottom.

The tower resists wind, wave and current forces by three mechanisms, namely the foundation, the buoyancy chambers, and the guy lines. The foundation provides restoring forces because the pilings located in the legs of the tower develop axial force couples which serve to resist wave forces. The buoyancy chambers provide a small restoring force to the platform. The guy lines are attached to the tower beneath the water surface to stabilize the tower against wave forces. The combination of these force-resisting elements provides the balanced system of the present invention to provide a tower construction which can be produced at minimal cost yet provide a long, useful operating life without sacrificing platform safety or without departing from conventional offshore operating procedures.

The primary object of the present invention is to provide an improved offshore tower to support a drilling and production platform wherein the tower is rugged in construction, is designed to withstand forces due to wind, wave action and water currents, yet the design of the tower provides maximum platform safety while permitting the use of conventional offshore operating techniques.

Another object of the present invention is to provide an offshore tower of the type described wherein the tower is provided with tubular legs which contain all or a portion of the piling and wells extending from the deck at the upper end of the tower to and into the sea bottom, the legs also presenting buoyancy chambers, and the tower having guy lines coupled thereto and extending outwardly and downwardly to the sea bottom so that the various forces exerted on the tower will be counteracted by the foundation, the buoyancy chambers and the guy lines to provide a platform support which exceeds the safety features and operating life of other conventional towers useful in water depths ranging from 1500 to 2500 feet.

Other objects of this invention will become apparent as the following specification progresses, reference being had to accompanying drawings for an illustration of a preferred embodiment of the invention.

IN THE DRAWINGS

Figure 1:
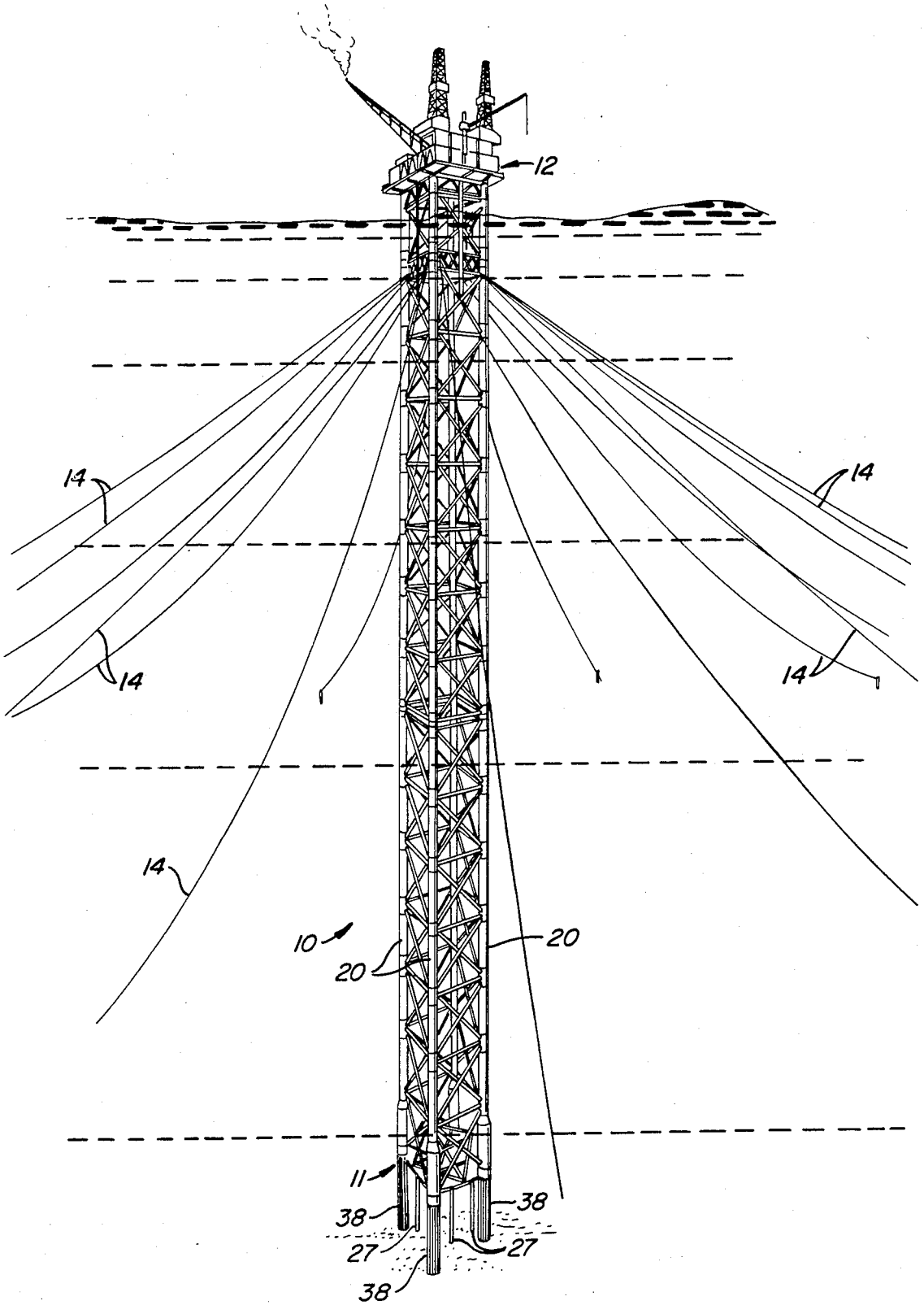
FIG. 1 is perspective view of the buoyant guyed tower of the present invention, showing the tower in its operative position for supporting a platform at the upper end thereof.
Figure 2:
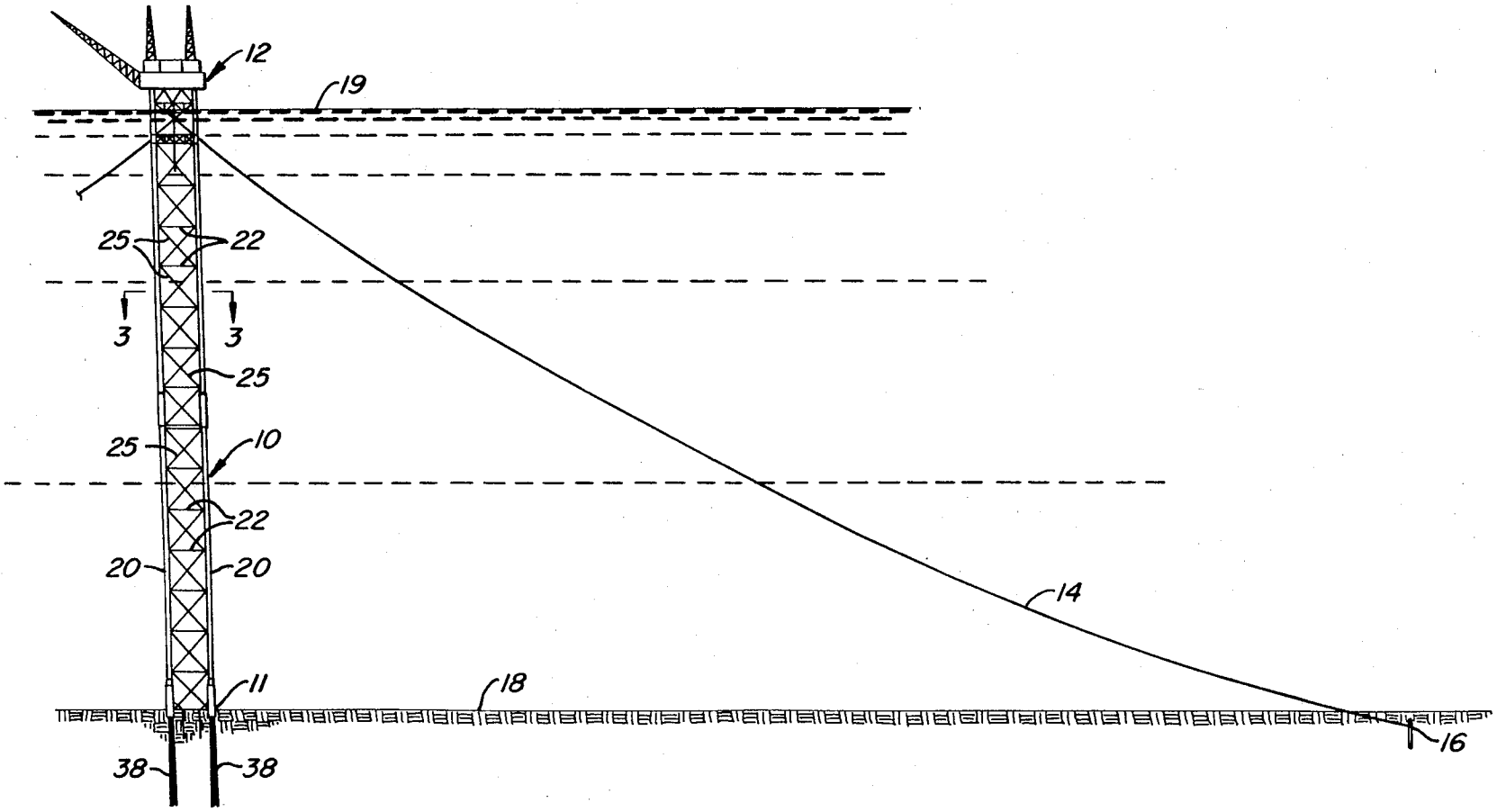
FIG. 2 is a side-elevational view of the tower of FIG. 1, showing the way in which guy lines are used to stabilize the tower against wave forces.

The buoyant guyed tower of the present invention is broadly denoted by the numeral 10 and is adapted to be mounted in an upright position with the lower end 11 of the tower embedded in the sea floor below the mud line 18 (FIG. 2) and with the upper end of the tower above the mean water line 19. A platform or deck 12 is mounted on the upper end of the tower above water line 19 and includes equipment for drilling wells into the sea floor and for providing hydrocarbon products flowing through the wells during production operations. As shown in FIGS. 1 and 2, a plurality of guy lines 14 are secured in any suitable manner to the upper portion of the tower near and below water line 19. The guy lines extend outwardly and downwardly from the tower to anchors 16 (FIG. 2) in the sea floor. The guy lines 14 are sufficient in number so that they are at specific locations about the tower. The purpose of the guy lines is to assist in stabilizing the tower against wave forces. A typical overall length of each guy line 14 is 4,500 feet. The anchor 16 is typically 50 feet below the mud line 18. The connection point of each guy line to the tower typically is 100 feet below water level.

Tower 10 is suitable for placement in water depths ranging from 1,500 to 2,500 feet. The tower hereinafter described will be assumed to be in water which is 2,000 feet deep; thus, a typical overall tower length is 2,050 feet. However, the tower as hereinafter described is provided with piles which piles extend even further downwardly below the mud line 18, such as to a distance of 300 feet or more. Wells or well casings hereinafter described are housed in the piles. The wells can extend 5,000 to 15,000 feet into the earth below the mud line 18.

Figure 3:
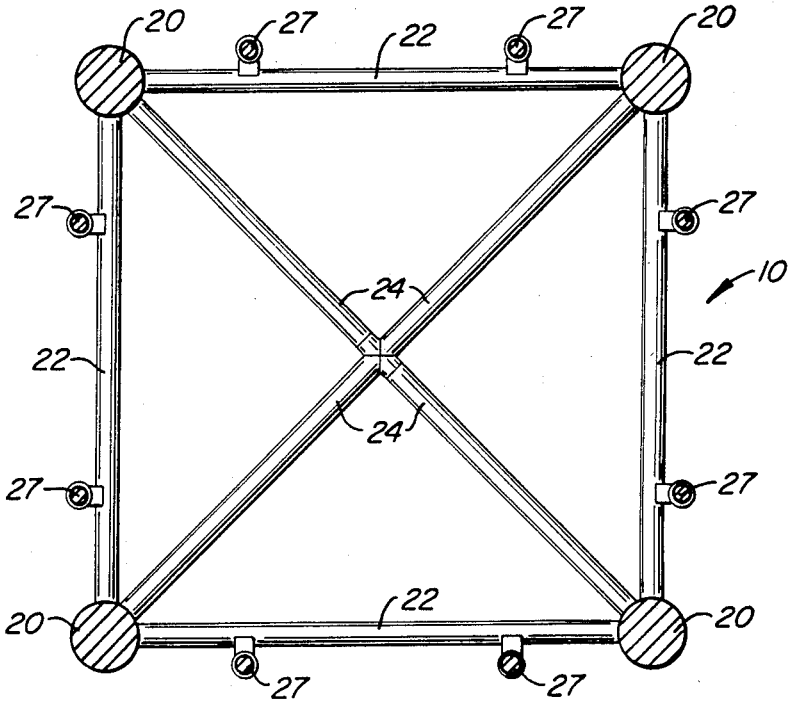
FIG. 3 is a horizontal section through an upper portion of the tower taken along line 3—3 of FIG. 2, showing four legs thereof supported by braces.
Figure 4:
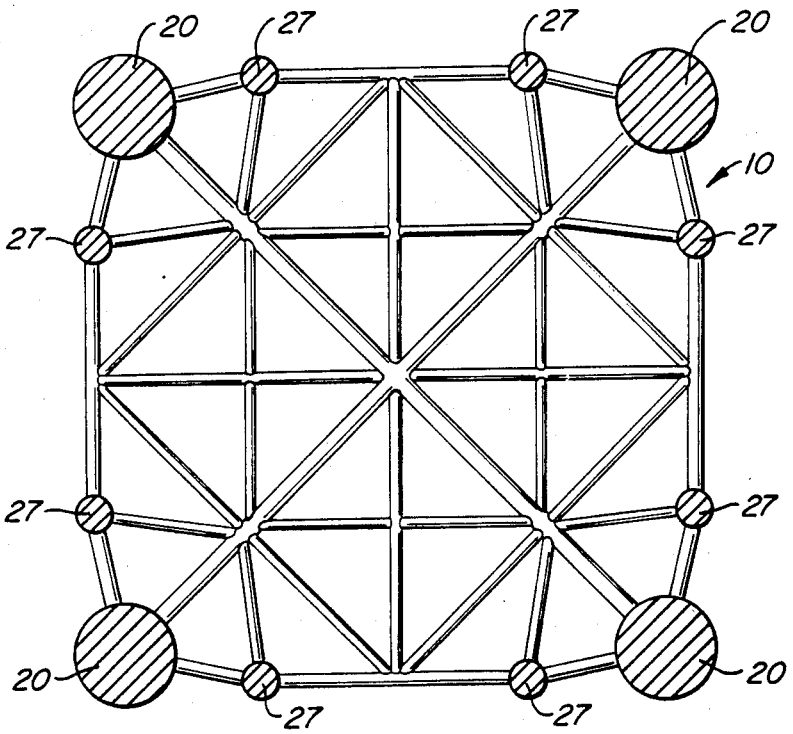
FIG. 4 is a view similar to FIG. 3 but showing a horizontal section of the tower near the lower end of the tower.

Tower 10 includes four tubular legs 20 at the corners of the generally square, horizontal cross-section of the tower, as shown in FIGS. 3 and 4. The legs are of a first outer diameter throughout a major portion of the length of the tower; then, the legs have a second outer diameter as they extend to the bottom of the tower. For instance, for a tower adapted to be placed in a 2,000-foot water depth, the outside diameter of each leg 20 to a depth of about 1,900 feet is typically 15–18 feet. Below that depth, the outer diameter of the leg is typically 24 feet. These outer diameter differences are shown in FIGS. 3 and 4, FIG. 3 showing the cross-section of the tower down to a depth typically of 1,900 feet, and FIG. 4 showing the cross-section of the tower at about 2,000 feet. A conical transition section 20*a* of leg 20 is shown in FIG. 5 for connecting the tower portion having the smaller diameter legs with the tower portion having the larger diameter legs.

The bracing provided for the tower for the smaller diameter leg portion as shown in FIG. 3 includes outer, horizontal braces 22, inner, horizontal braces 24 diagonally extending across the space between the legs, and inclined braces 25. In the foundation region of the tower as shown in FIG. 4, additional braces are provided to increase the stability of the tower and to compensate for lateral loads exerted on the foundation due to wind, wave action, and water currents. Shear piles in sleeves 27 can be used to supplement the lateral resistance of the foundation.

Figure 5:
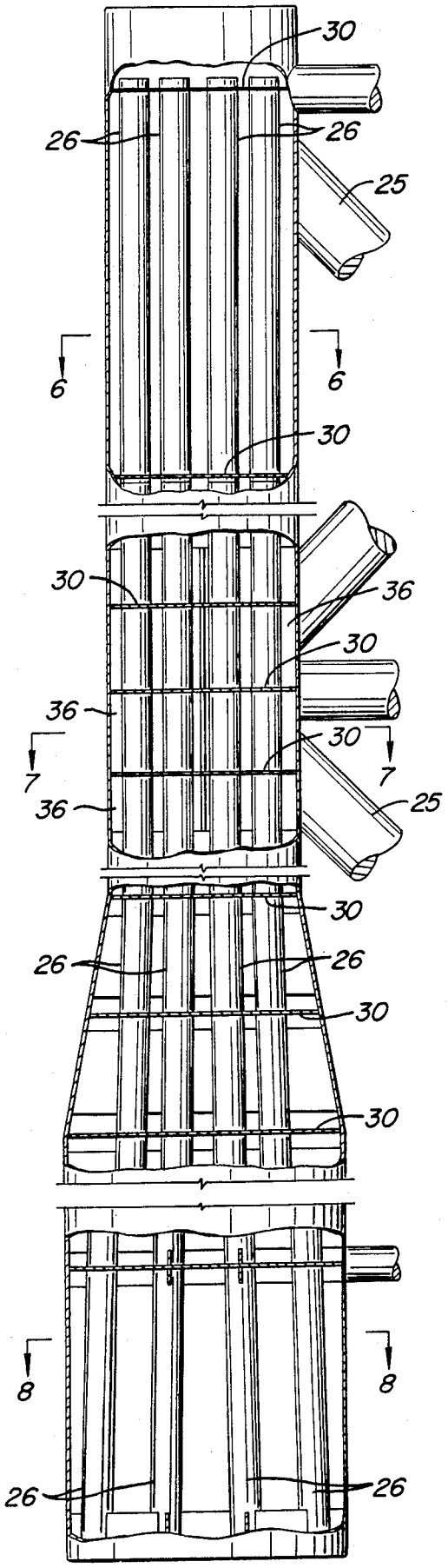
FIG. 5 is a fragmentary, side-elevational view, partly broken away and in section, of one of the legs of the tower.
Figure 6:
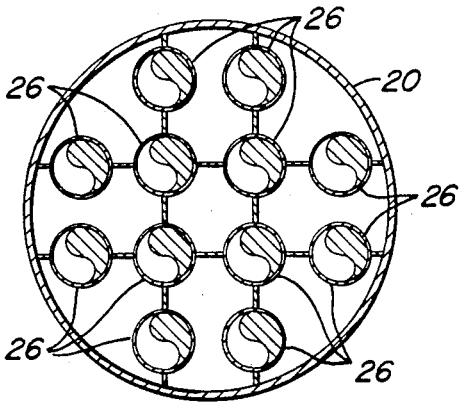
FIG. 6 is a cross-sectional view taken along line 6—6 of FIG. 5.

Each leg has a plurality of generally vertical sleeves 26 therein as shown in FIGS. 5–8. Sleeve 26 typically has an outer diameter of 31 inches. For purposes of illustration, each leg 20 has twelve sleeves 26. The sleeves 26 extend from a location near the upper end of each leg 20 to a location near the lower end thereof below mud line 18 as shown in FIG. 5. To accommodate the transition sections 20*a* of legs 20, the legs and the sleeves 26 thereof become slightly inclined as they extend downwardly through the bottom portion of the tower as shown in FIG. 5. Thus, in the bottom portion of the tower, the spacing between the legs is greater than the spacing between the legs above the transition section 20*a*.

Each leg 20 has a plurality of vertically spaced, horizontal imperforate plates or bulkhead 30 secured to the sleeves and connecting the sleeves to the inner surfaces of the legs. Thus, each plate 30 is disk-shaped and is welded or otherwise fastened to and surrounds each sleeve 26 to rigidify the sleeve. The sleeves 26 are held spaced apart by shear plates 34 (FIG. 6) located between the adjacent pairs of plates 30.

Figure 7:
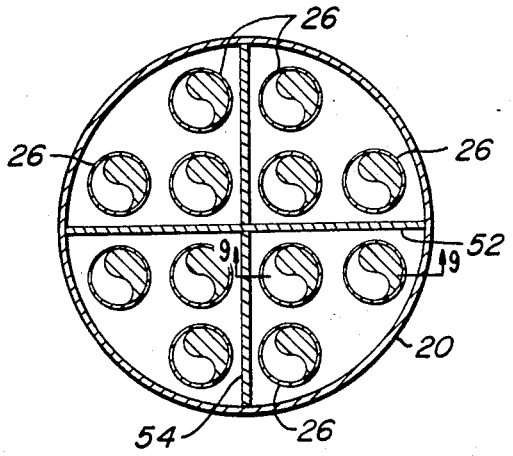
FIG. 7 is a cross-sectional view taken along line 7—7 of FIG. 5.
Figure 8:
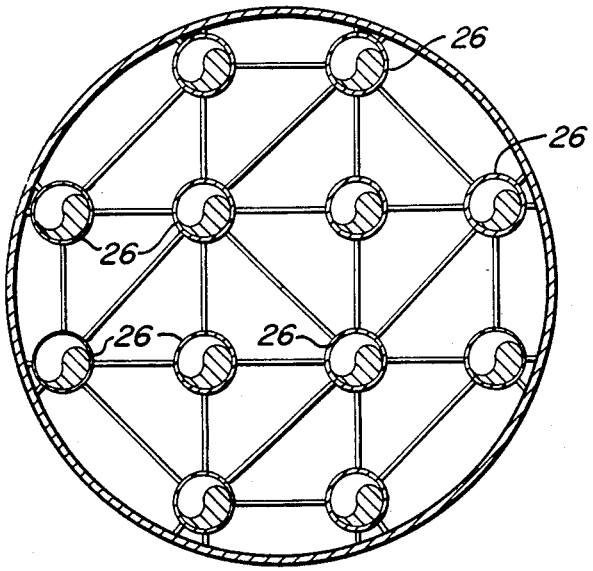
FIG. 8 is a cross-sectional view taken along line 8—8 of FIG. 5.
Figure 9:
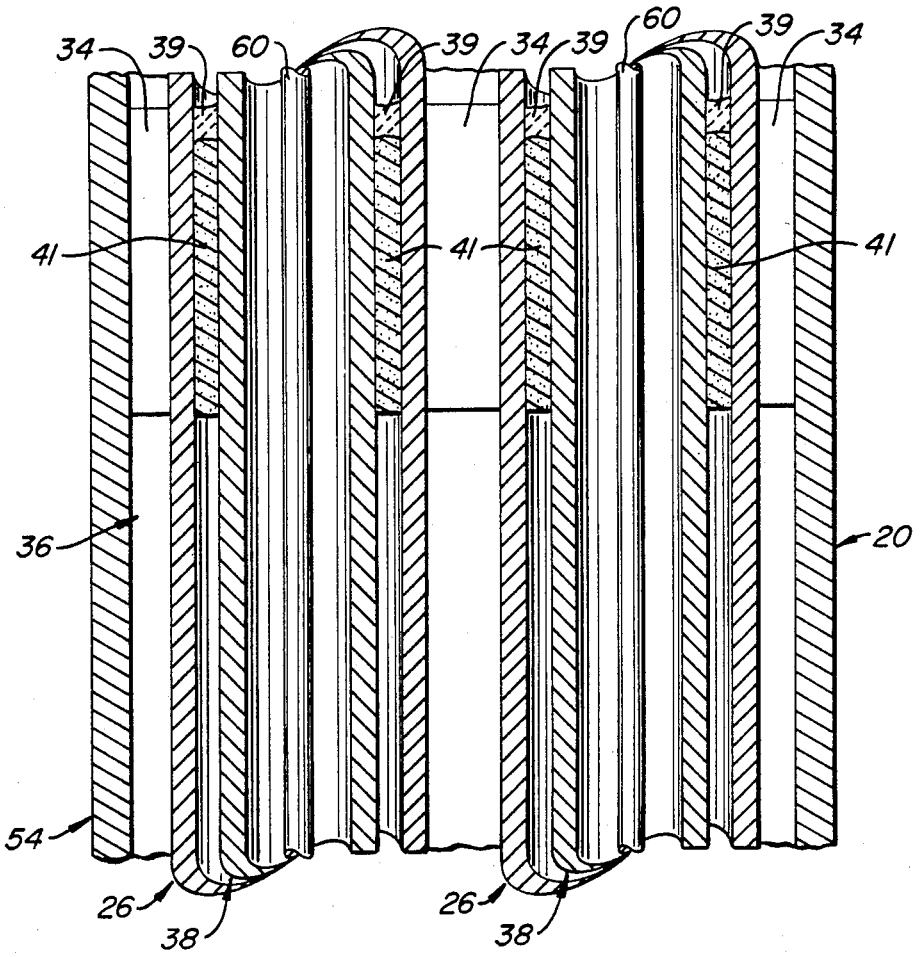
FIG. 9 is an enlarged, cross-sectional view taken along line 9—9 of FIG. 7.

Horizontal plates 30 divide each leg 20 into a series of closed air chambers 36 for providing buoyancy for the leg. These chambers 36 are filled with air and are generally out of fluid communication with each other; however, a piping system (not shown) can be coupled to the various chambers 36 to open the chambers to the atmosphere or to flood the chambers with sea water to reduce the buoyancy. The piping system is controlled from the platform 12 at the top of the tower. As shown in FIG. 7, each chamber 36 can be provided with a pair of vertical plates 52 and 54 perpendicular to each other for added structural support.

Each sleeve 26 has a tubular, resilient pile 38 extending therethrough. Each pile is secured at its upper end to the respective sleeve by welding at locations 39 and by grouting 41. The pile then extends downwardly through the respective sleeve and projects outwardly therefrom and outwardly from the respective leg into the sea bottom below the mud line 18. FIGS. 1 and 2 show the piles of each leg 20 extending into the sea bottom.

Each pile 38 serves as a compression spring for the corresponding leg 20 since the pile is made of a resilient steel pipe. This compression spring construction of each pile provides an upwardly directed restoring force tending to counteract the downward force of the weight of the platform. The piles of the four legs 20 also provide for compression and tension forces which develop tension-compression couples to counteract the rocking motion of the tower about the foundation or base due to wind, wave and water current forces.

Each pile 38 may provide a conductor for housing a well 60. Each well 60 extends downwardly from the platform 12, through the pile, to a location below the mud line and then downwardly into the sea bottom to a depth at which hydrocarbons to be produced are located. Thus, the piles 38 effectively protect the wells 60 from the damaging effects due to waves and water currents.

In use, with tower 10 erected as shown in FIGS. 1 and 2, piles 38 extend downwardly through respective sleeves 26 and into the sea floor, typically to a depth of 300 feet or more. Once the piles are in place, drilling operations can be conducted. During drilling operations, wells 60 are put into place and production of hydrocarbons or other minerals may commence.

Tower 10 resists wind, wave and current forces by the following three forces:

The restoring force of the foundation at the lower part of the tower, the buoyancy force provided by air chambers 36, and lateral forces provided by guy lines 14, all in roughly equal proportions. The foundation provides restoring forces because the piling is located in the corners of the structure inside the main legs and extends into the sea bottom for a considerable distance. When wind, wave and current forces are applied, these pilings develop tension-compression couples which serve to resist wave forces. The guy lines 14 assist in stabilizing the tower against wave forces. Finally, the buoyancy chambers contained within the main legs 20 provide a large restoring force to the platform 12.

We claim:

1. Apparatus for supporting an offshore drilling and production platform comprising:

a tower adapted to be mounted in an operative, generally upright position on the sea bottom and to extend upwardly to a location above the mean water level of the sea, the upper end of the tower adapted to be coupled to the platform in supporting relationship thereof; and a plurality of guy lines coupled to the tower near the upper end thereof and adapted to extend outwardly and downwardly therefrom in a number of different directions, the lower ends of the guy lines adapted to be anchored in the sea bottom;

said tower having a plurality of legs, each of the legs being tubular and having a buoyant chamber for exerting a buoyant resorting force on the tower when the tower is in said operative position;

there being a number of tubular piles extending into and through each leg, each pile being secured at its upper end to the corresponding leg near the upper end of the leg, each pile extending outwardly and downwardly from the lower end of the corresponding leg, whereby the lower ends of the piles can extend into the sea bottom when the tower is in said operative position;

each pile adapted to receive a well extending downwardly from the platform when the platform is mounted on and supported by the upper end of the tower, each well adapted to extend into the sea bottom for production of resources from a location below the sea bottom.

2. Apparatus as set forth in claim 1, wherein each leg is provided with a series of generally end-to-end buoyant chambers.

3. Apparatus as set forth in claim 1, wherein the upper ends of the guy lines are attached to the tower below the level of the prevailing sea when the tower is in its operative position.

4. Apparatus as set forth in claim 1, wherein each pile is formed of steel to provide for the formation of tension-compression couples to counteract the rocking motion of the tower when the tower is in said operative position.

5. Apparatus as set forth in claim 1, wherein at least one leg has a rigid sleeve therewithin, there being means for securing the sleeve to the inner surface of said one leg, said pile being secured at its upper end to said sleeve.

6. Apparatus as set forth in claim 5, wherein the sleeve has a length up to the same as that of said one leg.

7. Apparatus as set forth in claim 5, wherein the pile is secured by welding and grouting to said sleeve near the upper end of the sleeve.

8. Apparatus for mounting an offshore drilling and production platform above the water level of the prevailing sea comprising:

a tower having an upper end and a lower end, the tower adapted to be mounted in an upright position with the lower end supported on the sea bottom and with the upper end spaced above the water level of the sea;

a plurality of guy lines secured to the tower below the normal water line thereof, the guy lines adapted to extend outwardly and downwardly in a number of different directions from the tower, there being means for anchoring the lower end of each guy line to the sea bottom, said tower having a plurality of spaced, tubular legs, the lower ends of the legs adapted to extend into the sea bottom through a first distance when the tower is in said operative position;

means in each of said legs for providing a number of buoyant chambers therefor;

a plurality of spaced, rigid sleeves in each leg, respectively, the sleeves of each leg being generally parallel with each other and extending longitudinally of the respective leg, there being means rigidly connecting the sleeves to the inner surfaces of respective legs; and a tubular pile for each sleeve, respectively, each pile being secured at its upper end to the upper end of the respective sleeve, each pile extending through the respective sleeve and outwardly from the lower end of the respective leg through a second distance greater than said first distance, each pile adapted to receive and house a well extending from said platform into the sea bottom to a location below the lower end of the respective pile when the tower is in said operative position, whereby resources below the sea bottom can be produced and directed through the well to the platform.

9. Apparatus as set forth in claim 8, wherein each pile is formed from a resilient material.

10. Apparatus as set forth in claim 9, wherein said material is steel.

11. Apparatus as set forth in claim 8, wherein the upper end of the pile is near the upper end of the respective sleeve and is secured by welding and/or grouting to the respective sleeve.

12. Apparatus as set forth in claim 8, wherein the length of the tower is sufficient to allow it to be placed in water depths of 1200 to 2500 feet.

13. Apparatus as set forth in claim 8, wherein the buoyant chambers of each leg are in end-to-end relationship to each other.

* * * * *